United States Patent [19]

Patterson

[11] Patent Number: 4,867,372

[45] Date of Patent: Sep. 19, 1989

[54] MAILING/SHIPPING CONTAINER

[76] Inventor: Jeffrey Patterson, 1634 Murfin, Apt. 18, Ann Arbor, Mich. 48105

[21] Appl. No.: 187,853

[22] Filed: Apr. 29, 1988

[51] Int. Cl.[4] ..... B65D 5/56; B65D 43/16

[52] U.S. Cl. ..... 229/141; 40/312; 206/459; 206/521; 220/418; 229/921; 229/193; 229/73

[58] Field of Search ..... 229/16 A, 141, 3.1, 229/92.8, 921, DIG. 4, 136; 220/416, 418, 902; 206/309, 387, 424, 444, 459, 521, 631, 633; 40/312

[56] References Cited

U.S. PATENT DOCUMENTS

| | | | |
|---|---|---|---|
| 100,658 | 3/1870 | Osborn | 229/16 A |
| 210,576 | 12/1878 | Taylor | 229/16 A |
| 2,011,703 | 8/1935 | Barker | 206/424 |
| 2,400,406 | 5/1946 | Godoy | 206/813 |
| 2,989,221 | 6/1961 | Butler | 206/631 |
| 3,021,043 | 2/1962 | Phin | 229/141 |
| 3,184,149 | 5/1965 | Repko | 206/813 |
| 3,306,521 | 2/1967 | Giacovas | 229/136 |
| 3,608,707 | 9/1971 | Miller | 206/633 |
| 4,056,221 | 11/1977 | Piltz et al. | 220/418 |
| 4,444,354 | 4/1984 | Staelgraeve | 206/459 |
| 4,657,177 | 4/1987 | Karabedian | 229/3.1 |

FOREIGN PATENT DOCUMENTS

| | | | |
|---|---|---|---|
| 2579184 | 9/1986 | France | 220/416 |

*Primary Examiner*—Gary Elkins
*Attorney, Agent, or Firm*—Krass & Young

[57] ABSTRACT

A return mailer blank is provided for packaging a generally flat and/or rectilinear object. The mailer blank includes a flexible padding layer in sealed sandwich relation between opposed mutually matching envelope sheet layers serving as a mailing address layer and a return address layer.

The mailer blank has an end-flap pair which foldably comprises a rain-flap pair that serves when folded to provide protection against weathering or moisture in the area adjoining a seal flap.

The mailer blank in one embodiment has first and second main panels, each with an end-flap pair which are structured such that when folded one end flap fits into a pocket of the other, e.g. in tongue and groove fashion, to enable securing the ends of the package for forward mailing and return mailing.

15 Claims, 3 Drawing Sheets

FIG. 1
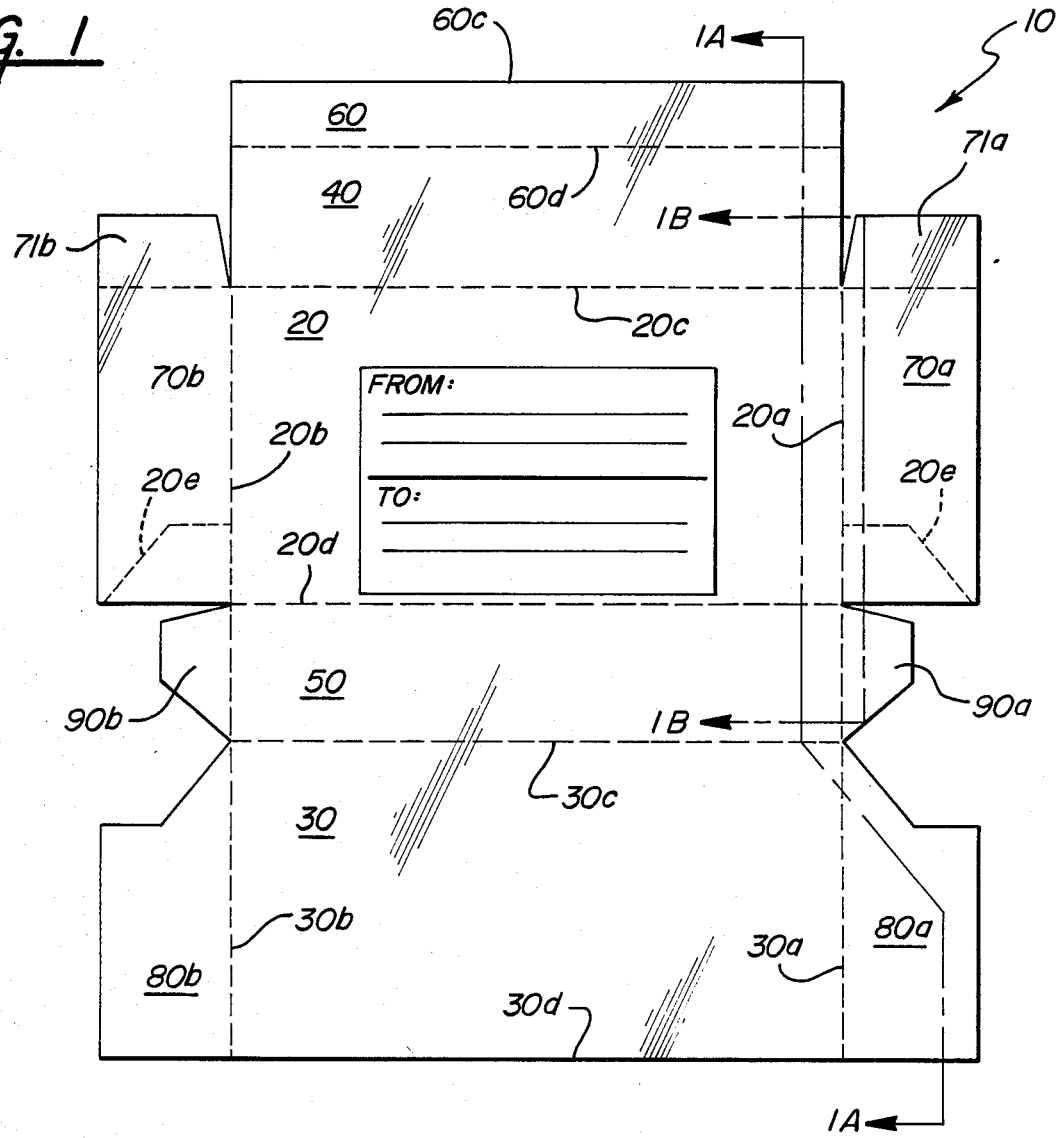
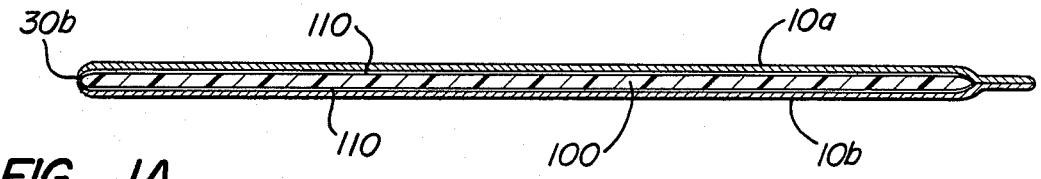
FIG. 1A
FIG. 1B
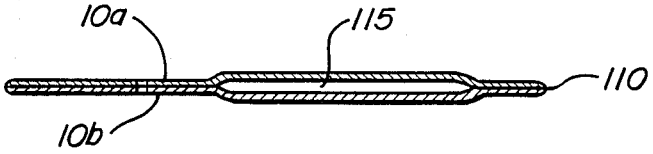

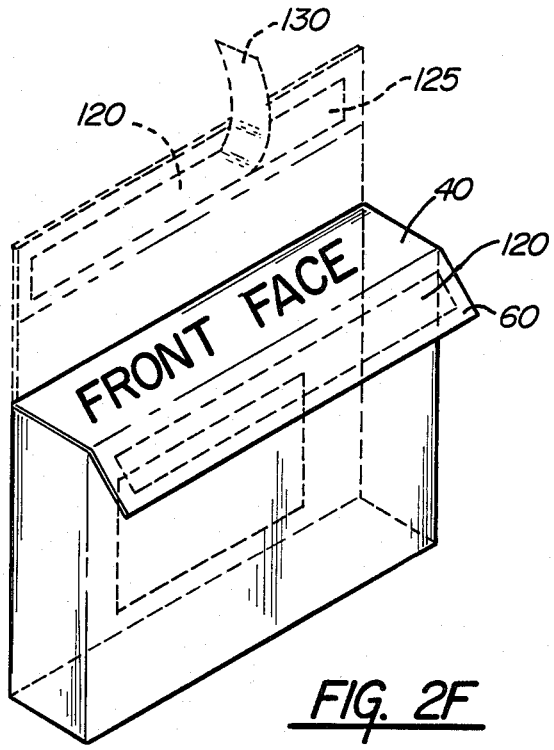
FIG. 2F
FIG. 2G
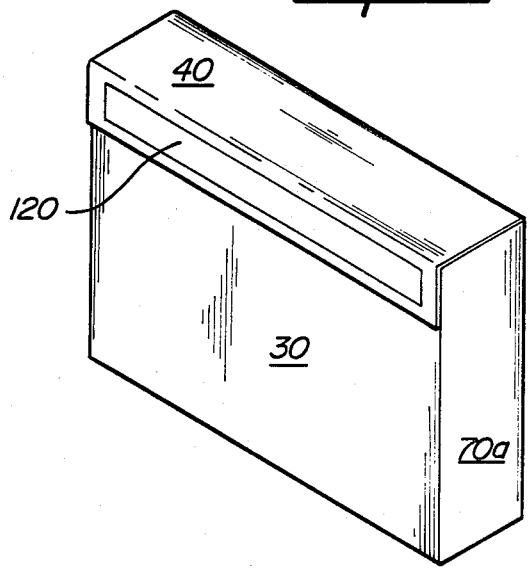
FIG. 3A
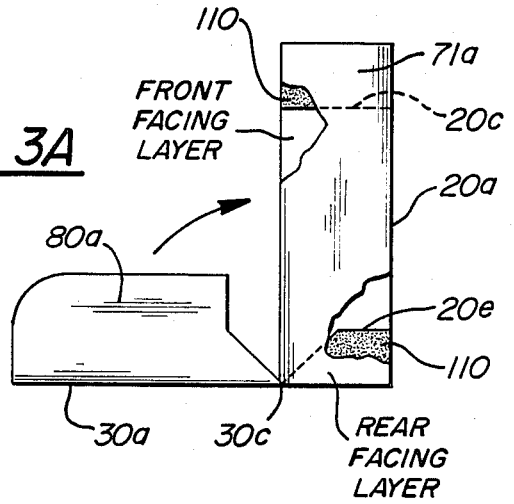
FIG. 3B
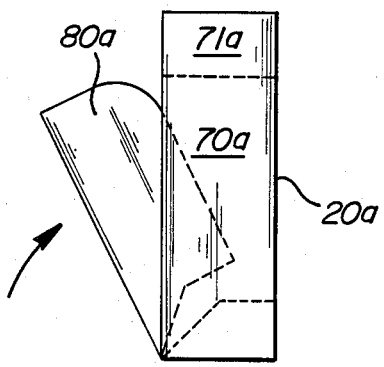
FIG. 3C
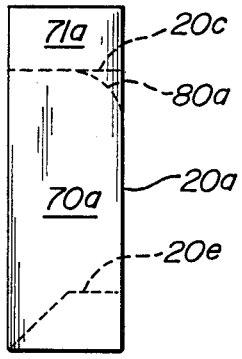

MAILING/SHIPPING CONTAINER

TECHNICAL FIELD

This invention concerns the field of packaging and more particularly relates to mailing or shipping containers, especially return mail containers and blanks for such containers.

BACKGROUND ART

Mailing containers are well known in the art and are used both for single delivery to a named addressee, and for two way delivery to a named addressee and addresser. However, under the general conditions experienced during handling the containers are often subjected to damage. Thus mailing containers must be generally durable for single delivery, but they must be especially durable for two way mail use. Further, mailing containers should also be economical to manufacture, easy to load and close, simple to open and provide a secure closing arrangement or construction to prevent unwanted opening. One such return mail container is described in the patent to Voytko, U.S. Pat. No. 4,046,311. The known container, however, purposely has a foldable panel and flap construction with predetermined fold lines that limits use of the container to an object having dimensions that are commensurate with the fold lines. Also, use of the container is inconvenient for the shipping of two like objects and return of only one. Further, use of the container is limited to one mailing and return since the container is opened by the addressee by severing the closure tab upon receipt.

It is therefore an object of the present invention to provide mailing or shipping containers and blanks therefor of the kind described which have flexible padded and unpadded panel and flap walls that can be variously folded on established fold lines or on fold lines deviating therefrom, for mailing and re-mailing an object or objects and that can accommodate single or plural objects.

It is a further object of the invention to provide reusable containers of the kind described which can be opened without removing or severing the closure or sealing means.

It is another object of the invention is to provide economical mailing containers and blanks therefor.

These and other objects, features and advantages will be seen from the following description and accompanying drawings in which:

FIG. 1 is a view of the front face or surface of a preferred embodiment of a mailer blank, according to the invention, having panel dimensions matching objects to be mailed and being suitable for mailing one object or two or more objects side by side (e.g. two conventional cassette tapes);

FIGS. 1A and 1B are sectional views of the mailer blank taken on lines A—A and B—B of FIG. 1;

Figure 2A:
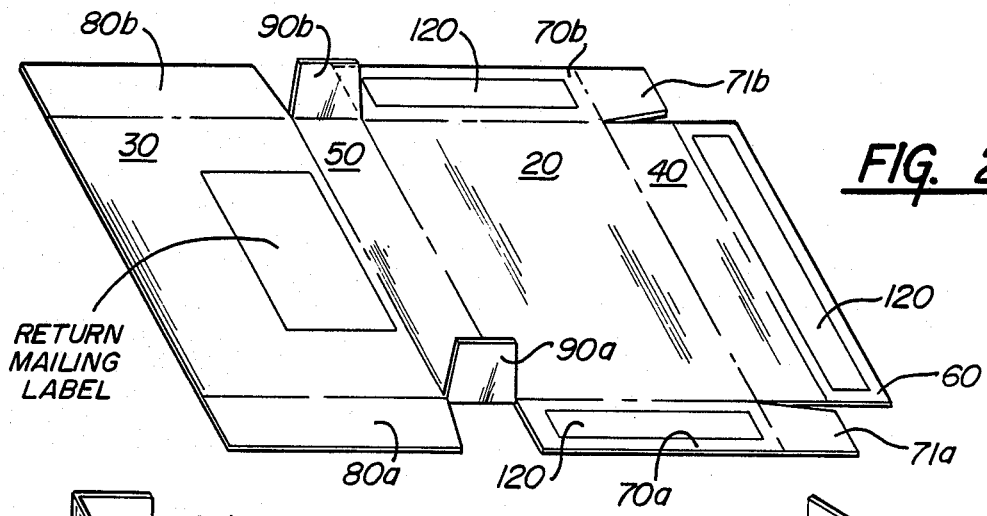
Figure 2B:
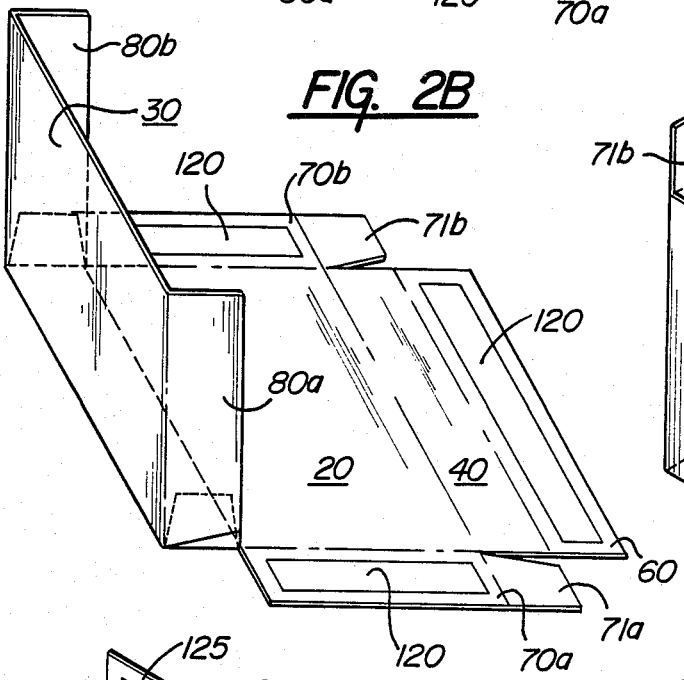
Figure 2C:
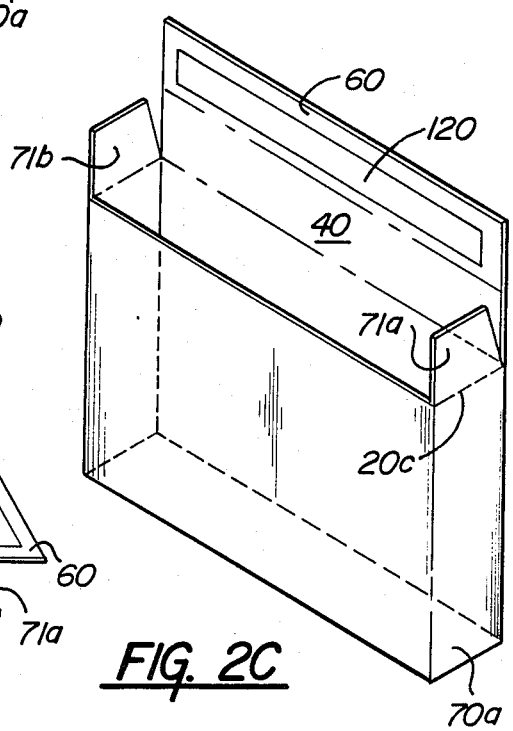

FIGS. 2A, 2B, 2C, 2D, 2E, 2F and 2G are views of successive steps taken in the assembly and folding of the elements for packaging of an object in a preferred mailer blank according to the invention; and FIGS. 3A (partly cut away) and, 3B and 3C are views, similar to that of FIG. 2C, of an end flap and a pocket end flap of a preferred mailer blank embodiment, illustrating the progressive insertion of the end flap into the pocket flap for purposes of enclosing an object (e.g. a conventional cassette tape of suitable size) in the mailer blank.

SUMMARY AND DETAILED DESCRIPTION

In a preferred embodiment, the invention concerns a return mailer blank for packaging a generally flat object, or objects such as books, cassette tapes, compact discs, and the like, for forward mailing and return mailing. The mailer blank is formed as a substantially uniform layer of flexible mailer padding in sealed sandwich relation between opposed matching envelope sheet layers serving respectively as a mailing address layer and a return address layer. The mailer blank comprises first and second main panels, a top panel, a bottom panel, and first, second and bottom end-flap pairs. The main panels are each quadrilateral, of substantially the same dimensions as the object to be packaged, and have opposed length edges and width edges. The top panel joins the first main panel on a first foldable line at a main panel length edge, and the bottom panel has opposed bottom length edge and width edges, and is adjacent to and hingeably joins two of the main panel length edges at the bottom panel length edges. The first, second and bottom end-flap pairs foldably join the first, second and bottom panels respectively at the width edges thereof. Each end-flap of the first end-flap pair foldably includes a unitary rain flap extending from a top protective edge of the end-flap which edge is an extension of the first foldable line between the top panel and the first main panel. The mailer blank padding layer and the envelope sheet layers are assembled or bonded together in any suitable way preferably by laminating them together with adhesive. In one preferred embodiment of the mailer blank, each of the end-flaps of the second end-flap pair is a wedge-shape flap and further, an zone exists between each first end-flap and its unitary rain-flap which zone lacks adhesive joining of the opposed sheet layers overlying the zone and thereby forms a wedge-shape pocket between the layers with an exposed opening at the flap end. The pockets match the respective wedge-shape flaps in thickness and lateral dimensions, and for packaging purposes are adapted for locating and receiving each of the wedge-shape end-flaps in closed package relation. The open pocket portion of the blank preferably lacks a padding layer. The main panels, top and bottom panels, and at least one of the main panel end-flap pairs include a padding layer, preferably a bubble pack layer or air bubble mailer layer which may be of a conventional layer material. The remaining end-flaps preferably lack a padding layer. In a preferred embodiment, the top panel has a first padded portion and a second or seal flap unpadded portion, and the bottom panel and the padded portion of the top panel are quadrilateral and are dimensioned to accommodate the thickness of an object or objects to be packaged. The seal flap portion joins the padded portion on a second foldable line at a length edge of the padded portion. Preferably, the seal flap portion on one face of the mailer blank comprises an activatable adhesive surface for sealing the seal flap portion to the second main panel at the opposite face of the blank. The adhesive surface, as referred to herein, can be activatable in any suitable way. For example, it can be a dry non-adhesive surface which becomes an active wet adhesive surface upon moistening or it can be an active or sticky adhesive surface covered by a protective release strip which on removal or separation from the surface exposes the active adhesive surface. In a preferred embodiment, the opposite faces of the seal flap portion each comprise an activatable adhesive surface so that when the adhesive surface of one face is activated preferably by removal of a protective strip covering the adhesive, the seal flap can be folded and sealed for forward mailing, and when the adhesive surface of the opposite face is similarly activated the seal flap can be reversely folded and sealed for return mailing. In a preferred embodiment, the activatable adhesive surface of the mailer blank of the invention is releasable so that when activated and sealed the seal flap can be opened for inspection, e.g. by providing the sealing area contacted by the adhesive with an art-recognized non-stick smooth polymeric release surface. For this purpose, the activatable adhesive surface is selected such that the seal flap is re-usable and can be re-sealed after opening the seal.

In another aspect, the invention concerns a return mailer blank for packaging a generally flat object or objects of the kind described, having first and second main panels, a top panel, a bottom panel, and first, second and bottom end-flap pairs, as described, the top panel having a first padded portion and a second or seal flap padded portion of the top panel being quadrilateral and dimensioned to accommodate the thickness of an object or objects to be packaged, and the seal flap portion joining the padded portion on a second foldable line at a length edge of the padded portion. The seal flap portion on one face of the mailer blank, and preferably on opposite faces of the flap portion, comprises an activatable adhesive surface for sealing the seal flap portion to the second main panel at the opposite face of the blank. Where the opposite faces of the seal flap portion each comprise an activatable adhesive surface, and the adhesive surface of one face is activated, preferably by removal of a protective strip covering the adhesive, the seal flap can be folded and sealed for forward mailing, and when the adhesive surface of the opposite face is likewise activated, the seal flap can be reversely folded and sealed for return mailing. Preferably the adhesive surface is releasable, as described, so that when activated and sealed the seal flap can be opened for inspection. For this purpose, the activatable adhesive surface is selected such that the seal flap is re-usable and can be resealed after opening the seal.

Referring to the drawing, FIG. 1 depicts a mailer blank 10 in a preferred embodiment, having a first main panel 20, a second main panel 30, a top panel 40, a bottom panel 50, a seal panel 60, and first, second and bottom end-flap pairs 70*a*, 70*b*, 80*a*, 80*b*, 90*a*, 90*b*. The mailer blank, which as shown is bilaterally symmetrical about a central vertical axis, has a front face or surface 10*a* (FIGS. 1A and 1B) and a reverse or rear face 10*b*. The front and rear faces have the same appearance and are functionally the same. The width edges 20*a*, 20*b*, 30*a*, 30*b* and length edges 20*c*, 20*d*, 30*c* join with the end-flap pairs 70*a*, 70*b*, 80*a*, 80*b*, 90*a*, 90*b* and with the top and bottom panels 40, 50, respectively, on nominal fold lines. These fold lines, however, are not fixed since the mailer blank is advantageously flexible and therefore can be readily folded and varied on any line chosen by the user to achieve a better fit with the contents of the mailer, as required. The end-flap pair 70*a*, 70*b* includes a rain-flap or cover-flap pair 71*a*, 71*b* that foldably join with the end-flap pair on a nominal fold line which is an extension of edge 20*c*.

Referring to FIGS. 1A and B, the same serve to show in cross-section the construction of the mailer blank. Thus, the mailer blank is a sandwich of a padding layer 100 laminated with an adhesive layer 110 between the front facing layer 10*a* and the rear facing layer 10*b*. The padding layer is generally co-extensive with the mentioned panels (main panels, top and bottom panels and seal panel), but does not extend beyond the width edges thereof except the width edges of the second main panel 30 where it is coextensive as an interlayer with the end-flap pair 80*a*, 80*b* (as seen in FIG. 1A).

The first end-flap pair 70*a*, 70*b* bottom end-flap pair 90*a*, 90*b*, and rain-flap pair 71*a*, 71*b*, in the illustrated embodiment, lack the padding layer and are a sealed laminate of the facing layers 10*a*, 10*b* held together by an adhesive layer 110 or other suitable bonding material, except in the open wedge shape pocket or zone 115 (FIG. 1B) defined by edges 20*a*, 20*c* and 20*e* (FIG. 1, shown in dotted outline). In other words, the end-flap pair 70*a*, 70*b* lacks an adhesive interlayer except for the area (again wedge-shaped) shown in FIG. 1 circumscribed by edges or lines 20*a*, 20*c* and 20*e*.

Figure 2D:
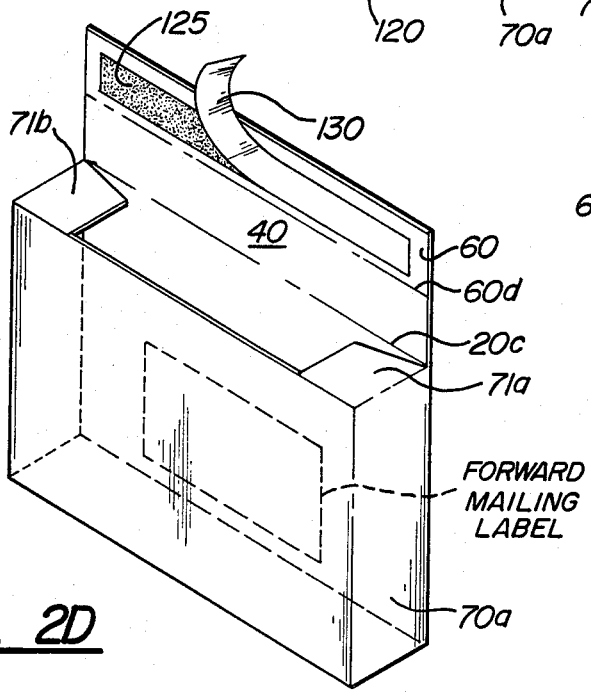
Figure 2E:
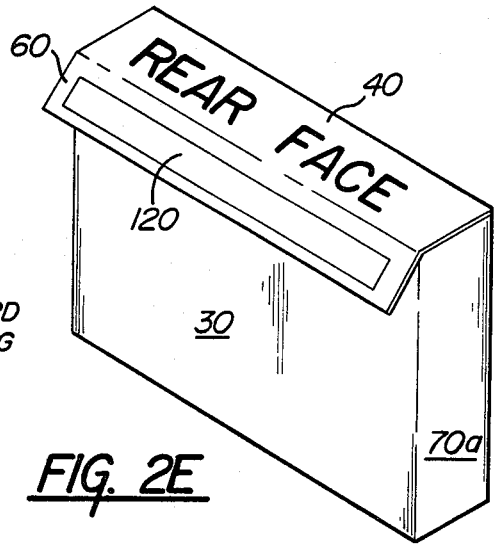

Referring to the series FIGS. 2*a* to 2*g*, these are views of successive steps taken in the assembly and folding of a preferred embodiment of the mailer blank of the invention, for packaging of an object or objects. For purposes of folding, depending on the dimensions of the object(s) to be packaged, the end flaps may be folded on the designated fold lines 20*a*, 20*b*, 30*a*, 30*b*, 50*a*, 50*b* or if convenient to do so (since the mailer blank is flexible and resistant), on fold lines that permissibly deviate from the designated fold lines. Similarly, the main panels, rain-flaps, and top and bottom panels may be folded on designated lines 20*c*, 20*d*, 30*c*, 60*d*. FIG. 2*a* shows the step in which the object (not shown) is placed between the up-folded end flaps 90*a*, 90*b*, of the mailer blank 10 with front face of the mailer blank up. In FIG. 2*b*, the end flaps 80*a*, 80*b* of the second main panel 30 are in-folded and the main panel is up-folded on fold line 30*c*. Next, in FIG. 2*c*, the first main panel is up-folded on a fold line 20*d*, the adhesive zone 120 of the end flaps 70*a*, 70*b* is activated, and the end flaps are in-folded and secured to the respective adjacent second main panel end flaps 80*a*, 80*b*. Activation of the adhesive can be accomplished in any suitable way such as by moistening a dry adhesive surface strip on the mailer blank or by removing a dry non-adhesive cover strip from an active adhesive surface. In FIG. 2*d*, the rain-flaps 71*a*, 71*b* are in-folded on a fold line 20*c* and the adhesive zone 120 of the seal flap 60 is activated by removing a cover strip 130 from the adhesive surface 125. In FIGS. 2*e* and 2*f*, the top panel 40 is in-folded on a fold line 20*c*; FIG. 2*e* represents the result obtained at this stage for forward mailing, and FIG. 2*f* represents the result obtained at this stage for return mailing (proceeding as in FIGS. 2*a* to 2*e*, but starting in FIG. 2*a* with the rear face of the mailer blank in the up position). FIG. 2*f* also shows the return mailing label (in dotted outline) an in phantom outline the upstanding position (comparable to FIG. 2*d*) of the top panel 40 and seal panel 60. Finally, in FIG. 2*g*, the seal panel is in-folded on a fold line 60*c* and the mailer blank is sealed. Preferably the adhesive surface is releasable for inspection purposes and is activated by removal of a protective strip or removal of the adhesive surface from a release surface. Thus, when the mailer blank is used for return mailing, the protective strip 130 (FIG. 2*f*) removed from the rear face of the mailer can be used to cover and protect the releasable adhesive surface 120 exposed by the opening of the forward mailed package.

As indicated above, FIGS. 3A and 3B are views of a preferred embodiment for securing the end flaps of the main panels. These views show the end flap 80*a* and a pocket end flap 70*a*. The views illustrate the progressive insertion of the end flap (from an upstanding position folded on a fold line 30*a* in planar alignment with the open pocket 115, FIG. 1B) into the pocket 115 of the pocket flap. In this regard, FIG. 3B shows the partial insertion of the wedge-shape flap 80*a* and in dotted outline FIG. 3C also shows the complete insertion of the flap into the pocket formed between the adhesive margins on designated lines 20*c* and 20*e*. When fully inserted and with the mailer blank sealed as shown in FIG. 2G, it is found that the mailer blank provides a reliable cover for forward and return mailing purposes.

Having thus described my invention, what I claim and desire by Letters Patent to secure are the following:

1. A return mailer blank for packaging a generally flat object, comprising:

a substantially uniform layer of flexible mailer padding in adhesively sealed sandwich relation between opposed first and second matching envelope sheet layers having respectively a front face for placing thereon a mailing address and a reverse face for placing thereon a return address, said mailer blank comprising first and second quadrilateral main panels of substantially the same dimensions as the object to be packaged, the main panels each having opposed length edges and width edges, a top panel joining said first main panel on a first foldable line at a main panel length edge, a bottom panel having opposed bottom length edge and width edges, said bottom panel being adjacent to and hingeably joining two of said main panel length edges at the bottom panel length edges, and a first end-flap pair, a second end-flap pair and a bottom end-flap pair foldably joining with the opposing width edges of the first panel, the second panel and the bottom panel respectively, said first end-flap pair each foldably joining with a unitary rain-flap extending from a top protective edge of each of said end-flaps which top edge is an extension of said first foldable line between the top panel and the first main panel where each of the end-flaps of the second end-flap pair is a wedge-shape flap and further where a zone exists between each first end-flap and its unitary rain-flap which zone lacks adhesive joining of the opposed sheet layers overlying the zone and thereby forms a wedge-shape pocket between the layers with an exposed opening at the end of each first end, said pockets matching said respective wedge-shape flaps and for packaging purposes being adapted for locating and receiving each of said wedge-shape end-flaps in closed package relation.

2. A mailer blank according to claim 1 wherein the padding layer is a bubble pack layer.

3. A mailer blank according to claim 1 where the open pocket portion of the blank lacks a padding layer.

4. A mailer blank according to claim 1 where the main panels, top and bottom panels, and at least one of said main panel end-flap pairs include a padding layer and further where the remaining end-flaps lack a padding layer.

5. A mailer blank according to claim 1 where the top panel has a first padded portion and a second or seal flap unpadded portion and further where the bottom panel and the padded portion of the top panel are quadrilateral and are dimensioned to accommodate the thickness of an object to be packaged.

6. A mailer blank according to claim 5 where the seal flap portion joins the padded on a second foldable line at a length edge of the padded portion.

7. A mailer blank according to claim 6 where the seal flap portion on one face of the mailer blank comprises an activatable adhesive surface for sealing the seal flap portion to the second main panel at the opposite face of the blank.

8. A mailer blank according to claim 7 where the opposite faces of the seal flap portion each comprise an activatable adhesive surface so that when the adhesive surface of one face is activated the seal flap can be folded and sealed for forward mailing, and when the adhesive surface of the opposite face is activated the seal flap can be reversely folded and the sealed for return mailing.

9. A mailer blank according to claim 7, where the adhesive surface is activatable by removal of a protective strip covering the adhesive.

10. A mailer blank according to claim 9 where the adhesive surface is releasable so that when activated and sealed the seal flap can be opened for inspection.

11. A mailer blank according to claim 10 where the adhesive surface is selected such that the seal flap is re-usable and can be sealed after opening the seal.

12. A return mailer blank for packaging a generally flat object, comprising:

a substantially uniform layer of flexible mailer padding in sealed sandwich relation between opposed first and second matching envelope sheet layers having respectively a front face for placing thereon a mailing address and a reverse face for placing thereon a return address, said mailer blank comprising first and second quadrilateral main panels of substantially the same dimensions as the object to be packaged, the main panels each having opposed length edges and width edges, a top panel joining said first main panel on a first foldable line at a main panel length edge, a bottom panel having opposed bottom length edge and width edges, said bottom panel being adjacent to and hingeably joining two of said main panel length edges at the bottom panel length edges, and a first end-flap pair, a second end-flap pair and a bottom end-flap pair foldably joining with the opposing width edges of the first panel, the second panel and the bottom panel respectively the top panel having a first padded portion and a second or seal flap unpadded portion, the top panel being quadrilateral and dimensioned to accommodate the thickness of an object to be packaged, and the seal flap unpadded portion joining the first padded portion on a second foldable line at a length edge of the first padded portion, the opposite faces of the seal flap portion each comprising an activatable adhesive surface so that when the adhesive surface of one face is activated the seal flap can be folded and sealed for forward mailing, and when the adhesive surface of the opposite face is activated the seal flap can be reversely folded and sealed for return mailing.

13. A mailer blank according to claim 12 where the adhesive surface is activatable by removal of a protective strip covering the adhesive.

14. A mailer blank according to claim 12 where the adhesive surface is releasable so that when activated and sealed the seal flap can be opened for inspection.

15. A mailer blank according to claim 14 where the adhesive surface is selected such that the seal flap is re-usable and can be resealed after opening the seal.

* * * * *